US005824994A

United States Patent [19]

Noda et al.

[11] Patent Number: 5,824,994

[45] Date of Patent: Oct. 20, 1998

[54] ELECTRICALLY HEATED TRANSPARENCY WITH MULTIPLE PARALLEL AND LOOPED BUS BAR ELEMENTS

[75] Inventors: Kazuyoshi Noda; Katsuaki Aikawa; Toshihiko Saito, all of Aiko-gun, Japan

[73] Assignee: Asahi Glass Company Ltd., Tokyo, Japan

[21] Appl. No.: 661,319

[22] Filed: Jun. 13, 1996

[30] Foreign Application Priority Data

Jun. 15, 1995 [JP] Japan ..... 7-149061

[51] Int. Cl.[6] ..... H05B 3/84

[52] U.S. Cl. ..... 219/203; 219/541

[58] Field of Search ..... 219/203, 522, 219/541; 52/171.2; 338/308, 309

[56] References Cited

U.S. PATENT DOCUMENTS

| | | | |
|---|---|---|---|
| 3,864,545 | 2/1975 | Schafer et al. | 219/203 |
| 4,940,884 | 7/1990 | Gillery | 338/309 |
| 5,208,444 | 5/1993 | Winter et al. | 219/203 |
| 5,653,903 | 8/1997 | Pinchok, Jr. et al. | 219/203 |

FOREIGN PATENT DOCUMENTS

| | | | |
|---|---|---|---|
| 59-46901 | 11/1984 | Japan | 219/203 |
| 8-31555 | 2/1996 | Japan . | |

*Primary Examiner*—John A. Jeffrey

*Attorney, Agent, or Firm*—Oblon, Spivak, McClelland, Maier & Neustadt, P.C.

[57] ABSTRACT

An electrically heated transparency which has a glass plate, a pair of bus bars provided at upper and lower sides of the glass plate and a transparent electric conductive film disposed on a surface of the glass plate so as to connect the pair of bus bars. The upper side bus bar has two upper bus bar elements. The upper bus bar elements are respectively extended to current feeding portions and have free ends at opposite positions in an upper side portion of the glass plate and near both sides of the transparent electric conductive film. The upper bus bar elements have parallel portions, in a connecting portion for connecting the upper side bus bar to the transparent electric conductive film, so as to oppose to each other with a space, and the upper bus bar elements are in contact with the transparent electric conductive film at the parallel portions.

9 Claims, 5 Drawing Sheets

ELECTRICALLY HEATED TRANSPARENCY WITH MULTIPLE PARALLEL AND LOOPED BUS BAR ELEMENTS

BACKGROUND OF THE INVENTION

1. Field of the Invention

The present invention relates to an electrically heated transparency useful for, for instance, a windshield glass for a vehicle, a window glass for a building or the like.

2. Discussion of Background

In winter seasons or cold areas, deposition of snow, ice, frost, or moisture or the like takes place on the front glass, the rear glass and so on of trains, electric cars, trucks, passenger cars and so on or a window glass for a building to prevent eyesight. It is difficult to quickly remove such substance. In order to solving these problems, there has been proposed to use an electrically heated transparency for a window.

A conventional electrically heated transparency, e.g., a windshield glass for a vehicle comprises two glass plates of substantially trapezoidal shape corresponding to the shape of a window frame, a resinous film interposed between the two glass plates, a pair of bus bars (electrodes for feeding a current) which are disposed between the two glass plates at upper and lower positions or left and right positions in the peripheral portion of the glass plates and a transparent electric heating film (transparent electric conductive film) connected to the bus bars.

As the transparent electric heating film, an ITO (a compound oxide of indium and tin) film or a thin film of gold or silver is used, for instance. A current is supplied to the transparent electric heating film from a battery or the like through the bus bars to thereby heat the windshield glass, whereby melting of snow, ice or a non-fogging effect can quickly be performed by heat generated.

Recently, various kinds of transparent electric feeding film used for an electrically heated transparency have been developed, and glass can be heated more quickly. For instance, there has been known a gallium-containing zinc oxide film suitable for heating a glass plate by applying a high voltage of 280 V or more.

In such an electrically heated transparency, when the glass is broken, or a crack is produced at car crushing, and if a current is continuously supplied in a state of the breakage, there is a danger of causing an electric shock, abnormal heating, firing, smoking or the like. In order to eliminate the dangerous state, there has been proposed an improved method of feeding a current to the bus bars or provision of a crack detector for detecting the breakage of glass.

FIG. 6 shows a conventional arrangement of bus bars. As shown in FIG. 6, a set of bus bars 1, 2 are provided, and a current is fed from terminals of the bus bars, which are located at a lower left side of the glass plate (the feeding system is referred to as a side electricity feeding system). FIG. 8 also shows a conventional side electricity feeding system.

In the side electricity feeding system, when the resistance of the bus bars is high, a loss due to heat generated in the bus bars is produced, and power to be applied to the transparent electric heating film becomes small, whereby there is a loss of power. Further, in the side electricity feeding system, when a bus bar is broken by an accident or the like, a spark or abnormal heating takes place at the damaged portion depending on a state of the breakage, and in the worst case, fire may happen in the resinous interlayer. Namely, the side electricity feeding system has a drawback of causing a spark, firing, smoking or the like depending on the magnitude of a current flowing in the bus bar or a degree of breakage.

There has been proposed a two side electricity feeding system as shown in FIG. 7 wherein terminals are provided at left and right sides of an upper side bus bar 1 and a lower side bus bar 2 respectively, and electricity is fed through the terminals at left and right end sides of the bus bars. In such system, even when any bus bar at a left or a right side or a portion of the bus bar at an upper portion of the glass is broken, a potential difference does not appear at the damaged portion of the bus bar whereby occurrence of fire due to a spark or abnormal heating can be suppressed.

Japanese Unexamined Patent Publication No. JP446847 proposes a crack detector for detecting a breakage of glass by utilizing the two side electricity feeding system and by detecting a current value flowing in a left or right bus bar portion of an upper side bus bar 1, the left and right bus bar portions being located in the vicinity of left and right side portions of a glass plate.

In the above-mentioned breakage detecting system in the two side electricity feeding system, however, it was difficult to detect accurately the breakage of the upper side bus bar 1 at a portion contacting to an upper transparent electric heating film portion because an amount of a change of current is very small even though it can detect the breakage in a case that the bus bar is broken at a left or right side portion of the glass plate. In particular, when the glass plate is heated by applying a high voltage of 280 V or more, a current passing therethrough was usually small, and a change of current at the breakage of the glass plate was very small, whereby the detection of the breakage was difficult.

SUMMARY OF THE INVENTION

It is an object of the present invention to provide an electrically heating glass free from a spark or an electric shock and excellent in safety even when a crack is produced in a windshield glass for a vehicle or a window glass for building, and a part of a bus bar is broken in any portion of the glass plate.

In accordance with the present invention, there is provided an electrically heated transparency which comprises a glass plate, a pair of bus bars provided at upper and lower sides of the glass plate and a transparent electric conductive film disposed on a surface of the glass plate so as to connect the pair of bus bars, wherein the upper side bus bar comprises a plurality of upper bus bar elements; said upper bus bar elements are respectively extended to current feeding portions and have free ends at opposite positions in an upper side portion of the glass plate and near both sides of the transparent electric conductive film; said upper bus bar elements have parallel portions, in a connecting portion for connecting the upper side bus bar to the transparent electric conductive film, so as to oppose to each other with a space, and said upper bus bar elements are in contact with the transparent electric conductive film at the parallel portions.

Namely, the shape of the upper side bus bar in the set of bus bars which are connected to upper and lower opposing sides of the transparent electric conductive film as an element of the electrically heated transparency, in particular, the shape of the portion for connecting the bus bar to the transparent electric conductive film should satisfy the following conditions.

1) There are a plurality of upper bus bar elements each having a free end at or near a side of the transparent electric conductive film connected to the bus bar, and each of the upper bus bar element has a parallel portion, which are in an adjacently opposing relation without any contact portion to each other, and 2) the upper bus bar elements in 1) are in contact with the transparent electric conductive film at the parallel portion (hereinbelow, referred simply as a bus bar parallel portion).

In the present invention, the upper portion of the drawings is referred to as "upper side" for convenience. The "upper side" may be a left or right portion or a lower portion depending on a state of use of an assembled electrically heating glasses of the present invention.

When a plurality of upper bus bar elements are connected to a single current feeding portion to form a single bus bar structure, the construction of the current feeding portion can be simplified. The plurality of bus bar elements may be used in a plural number of more than two. In practical use, however, two bus bar elements are preferably used.

In the present invention, the current feeding portion is determined at a portion of the bus bar wherein a current is fed to the bus bar through a current feeding terminal. Accordingly, when the current feeding terminal is provided on the bus bar, the position of the current feeding portion corresponds to the position of the current feeding terminal. In the present invention, the words "free ends" mean "ends" of the bus bar elements at positions other than the current feeding portion.

In the electrically heating glass having the above-mentioned construction of the present invention, a potential difference is not produced in the same manner as described with reference to the both side current feeding system even when a breakage of bus bar is resulted at any position, i.e. even though breakage is resulted either in upper or lower or left or right side portion of the glass plate. Accordingly, there is little possibility of a spark, abnormal heating, fire or the like at the breakage portion. Further, since a potential difference between two bus bar elements in the bus bar parallel portions is small in the electrically heated transparency of the present invention, an amount of a current flowing between the bus bar elements is small. Actually, an amount of a current flowing in the parallel portion of the bus bar element at an outer side of the glass plate between the two bus bar elements is smaller than an amount of a current flowing in the parallel portion of the bus bar element at the inner side between the two bus bar elements.

Accordingly, when the bus bar element at the inner side is broken, the current reducing ratio of the inner bus bar element and/or the current increasing ratio of the outer side bus bar element is large in comparison with the case of the conventional two side electricity feeding system, and performance of detecting a breakage by means of a current monitor is further sensitive and reliability is improved.

In the electrically heated transparency of the present invention, another crack detecting means for detecting electrically the occurrence of a crack in the glass plate may be provided to further improve reliability.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1A:
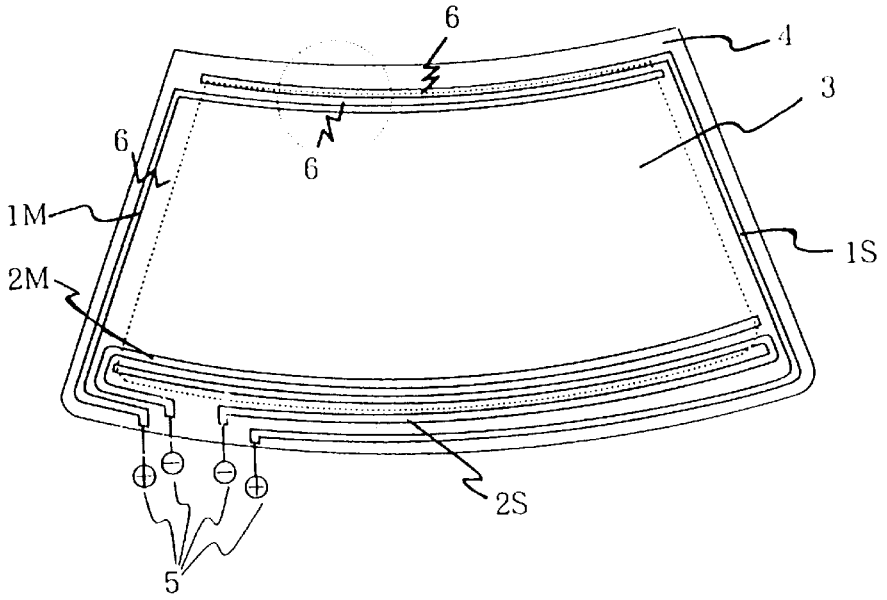
FIG. 1*a* is a diagram showing an embodiment of the electrically heated transparency of the present invention.

Preferred embodiments of the present invention will be described with reference to the drawings. The glass plate used in the present invention may be an ordinary glass plate, a strengthened glass plate, a partially strengthened glass plate or the like. It may also be colored to the extent that the transparency is not reduced. Further, the glass plate used is not limited to a flat plate-like form, but it may have various kinds of shape or have a curved surface bent with a predetermined radius of curvature. For instance, it may have a substantially trapezoidal form having a curved surface, which may be used for a front glass for various kinds of vehicle.

A lamination glass prepared by bonding two glass plates may be used, or a lamination of a glass plate and a plastic sheet may be used.

Although the thickness of the glass plate used is not in particular limited, a thickness of about 1.5–5 mm is generally used.

The lamination glass comprises two glass plates, an resinous interlayer interposed between the two glass plate, at least one pair of bus bars disposed on a glass plate between the two glass plates and a transparent electric conductive film provided to connect the pair of bus bars.

The resinous interlayer used in the present invention should be such one capable of strongly bonding two glass plates which sandwich the interlayer when a lamination glass is formed, and preventing fragments of glass from scattering even when the lamination glass is broken. For this purpose, a polyvinyl butyral film having improved physical properties such as adhesion properties, light resistance, heat resistance and so on is preferably used. The thickness of the resinous interlayer is not in particular limited. However, a thickness of about 0.2–0.9 mm is generally used.

For preparing the lamination glass, a known method may be used. For instance, two glass plates are bonded by interposing a resinous film, and the lamination is subjected to a preliminarily bonding, a treatment in an autoclave and so on to thereby form a predetermined lamination glass.

In the electrically heated transparency of the present invention, a desired transparent electric conductive film and a set of bus bars connected thereto are provided between two glass plates in order to form a lamination glass. In this case, it is preferable to arrange the transparent electric conductive film suitably selected and the set of bus bars on the side of one of the glass plates, preferably on the glass plate located at the side of the cabin of a vehicle, so as to face the resinous interlayer. Then, the glass plate provided with the transparent electric conductive film and the set of bus bars and the other glass plate which faces the outside of the vehicle are integrally bonded interposing the resinous interlayer.

The transparent electric conductive film used in the present invention may be selected from various kinds of film formed of known electric conductive material. A suitable film can be selected depending on the purpose of use. A voltage applied to the transparent electric conductive film is different depending on a kind of the film used. Accordingly, the bus bars connected to the transparent electric conductive film are formed so as to meet optimum conditions.

As specific examples of the transparent electric conductive film used in the present invention may be an ITO film as a compound oxide film of indium and tin or a thin film of gold or silver which can be used in a relatively low voltage (a high current value).

The transparent electric conductive film used at a high voltage (a low current value) may be an ITO film, a tin oxide film, a gallium-containing zinc oxide film or the like which is used by applying a voltage of 288 V to the bus bars. In the present invention, an equivalent effect can be achieved even when either a low voltage or a high voltage is applied.

In order to form the transparent electric conductive film on the glass plate, a known method such as a vacuum vapor deposition method, a sputtering method, an electron beam heating vapor deposition method, a spray method, a CVD method can be used.

The bus bars connected to the transparent electric conductive film formed by the above-mentioned method to feed a current to the film, may be formed by a method wherein a silver paste is printed followed by baking. The electrically heated transparency of the present invention has such a feature that the bus bars have unique shapes. Namely, the upper side bus bar comprises bus bar elements having parallel portions.

The distance between two bus bar elements in the parallel portions is preferably about 0.5–30 mm, more preferably, about 1–5 mm.

In the lower side bus bar, there is less possibility of causing breakage owing to its location and length in comparison with the upper side bus bar. Accordingly, the construction of the lower side bus bar is not in particular limited, and the conventional side electricity feeding system can be employed. However, it is preferable to use a suitable structure which performs the same function as in the both side electricity feeding system.

Figure 1B:
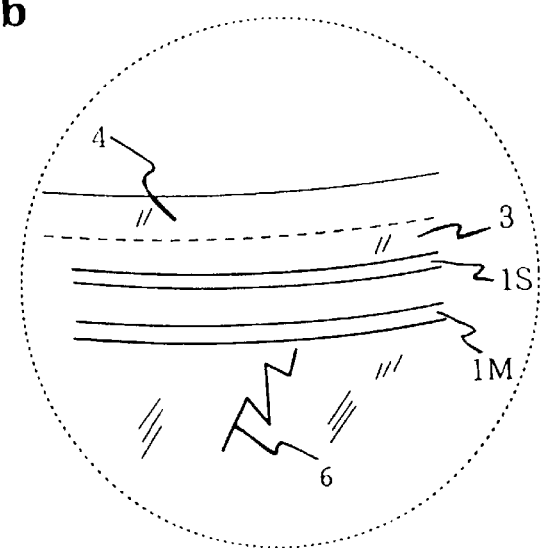
FIG. 1*b* is a diagram showing an enlarged portion in FIG. 1*a;*

For instance, the structure as shown in FIG. 1 can be used wherein the lower side bus bar comprises a plurality of lower bus bar elements in the same manner as in the upper side bus bar; the lower bus bar elements are respectively extended to current feeding portions and have free ends at opposite positions in a lower side portion of the glass plate and near both sides of a transparent electric conductive film; the lower bus bar elements have parallel portions, in a connecting portion for connecting the lower side bus bar to the transparent electric conductive film, so as to oppose to each other with a space, and the lower bus bar elements are in contact with the transparent electric conductive film at the parallel portions.

Figure 2:
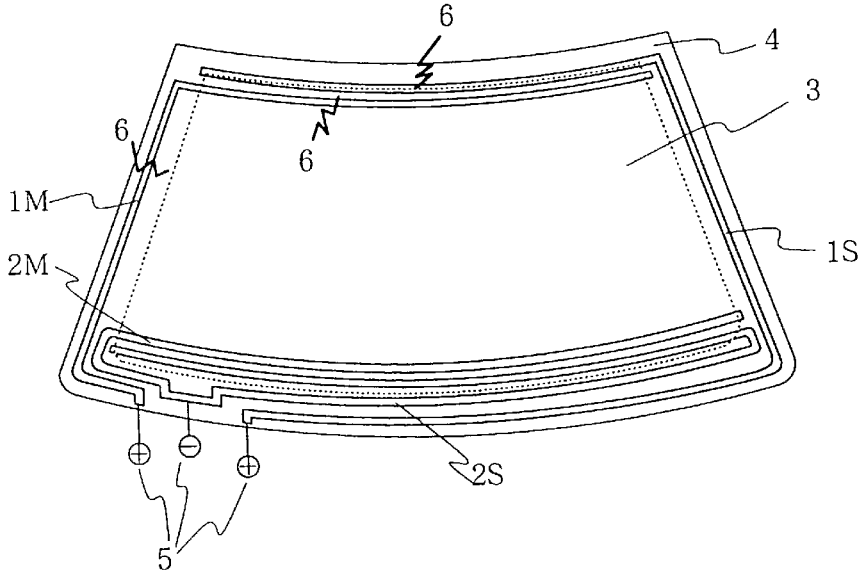
FIG. 2 is a diagram showing another embodiment of the electrically heated transparency of the present invention.

Further, as shown in FIG. 2, there is a structure that the above-mentioned plurality of lower bus bar elements are connected to a single current feeding portion so as to form a single line. The plurality of bus bar elements may be used in a plural number of more than two. In practical use, however, two bus bar elements are preferably used.

Figure 4:
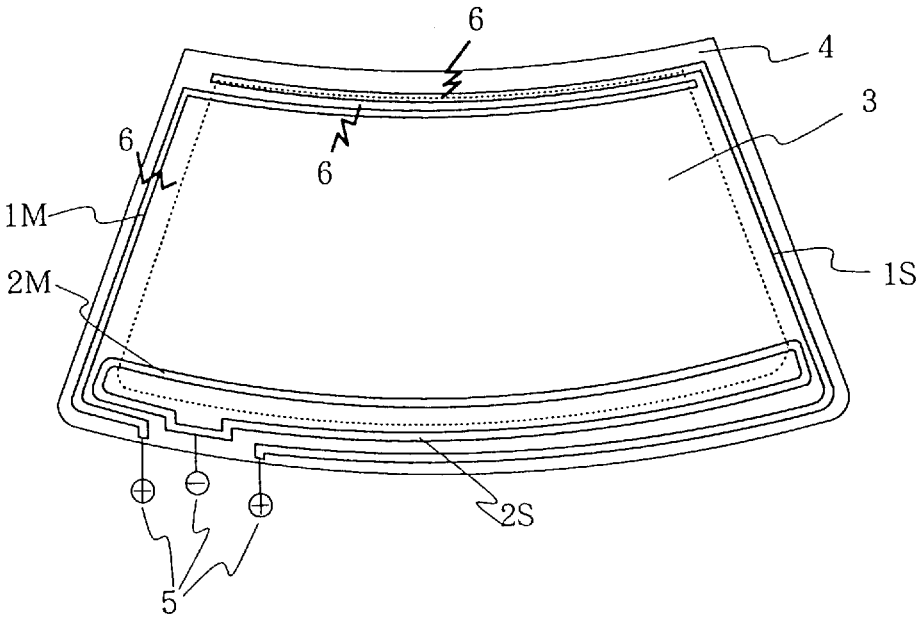
FIG. 4 is a diagram showing another embodiment of the electrically heated transparency of the present invention.

Further, as shown in FIG. 4, there is a structure that the lower side bus bar are in a loop-like shape, and a part of the loop-like bus bar is in contact with the transparent electric conductive film.

When the lower side bus bar is in a structure of having a bus bar parallel portions, it is preferable that the space between two bus bar elements is about 0.5–30 mm, in particular, about 1–5 mm.

Now, the present invention will be described in detail with reference to Examples. However, it should be understood that the present invention is by no means restricted by such specific Examples. In the following Examples wherein a front glass for vehicle is in a substantially trapezoidal form as shown in FIG. 1, an upper side of the glass plate means an upper portion of the trapezoidal shape and a lower side means a lower portion of the trapezoidal shape. Further, right and left sides of the glass plate means equal leg portions of the trapezoidal shape.

EXAMPLE 1

FIG. 1 shows a shape of bus bars. Both end portions of a set of bus bars are connected to current feeding terminals 5 of positive pole and negative pole. Each of the set of bus bars comprises two bus bar elements, hence, there are four bus bar elements in total.

In FIG. 1, numeral 4 designates a glass plate, and numeral 3 designates a transparent electric conductive film 3 which is shown by a dotted line in a similar shape of the glass plate 4. In this Example, a layer of multi-layered structure including a gallium-containing zinc oxide film was used for the transparent electric conductive film 3.

In Example 1, the bus bar disposed at an upper side of the glass plate comprises two bus bar elements 1M and 1S which are connected to one of the poles, and the bus bar disposed at a lower side of the glass plate comprises two bus bar elements 2M and 2S which are connected to the other of the poles. The set of bus bars are constituted by four bus bar elements. The respective end portions of the bus bars are located at the left of the lower side of the glass plate, and the end portions are connected to an outer power source through a current feeding portion. Further, the end portions may be connected to a current detecting means (not shown).

In this Example, the current feeding terminals are collected at the left of the lower side of the glass plate. However, terminals for the bus bar elements 1M and 2M may be disposed at the left of the lower side of the glass plate and the terminals for the bus bar elements lS and 2S may be disposed at the right of the lower side of the glass plate.

Further, in this Example, arrangement is so made that each part of the bus bar elements 1M and 1S is respectively connected to the transparent electric conductive film, and they have its free ends near opposite sides of the connected transparent electric conductive film so as to oppose to each other. The portion of the bus bar elements 1M and 1S connected to the transparent electric conductive film have parallel portions which oppose each other with a space.

In the same manner as above, the bus bar elements 2M and 2S at the lower side of the glass plate have respectively parallel portions, which are connected to the transparent electric conductive film.

In other words, in the bus bar of this Example, the parallel portions are formed by the two bus bar elements 1M and 1S at or near the upper side of the glass plate and the parallel portions are formed by the two bus bar elements 2M and 2S at or near the lower side of the glass plate, and further, the two bus bar elements forming the parallel portions are respectively in contact with the upper side and the lower side of the transparent electric conductive film. In this case, it is preferable that the length of the parallel portions of the bus bar elements, in particular, the length of the inner side bus bar elements is substantially the same as or slightly longer than the length of the upper and lower sides of the transparent electric conductive film since a current should be supplied in the entire area of the transparent electric conductive film when power is supplied.

As shown in FIG. 1, the two bus bar elements which are in contact with the upper side of the transparent electric conductive film are extended along the side portions of the glass plate, and the two bus bar elements are connected to a current feeding portion which may be located in any position at the lower side of the glass plate.

A current is supplied (at a voltage of 288 V, for instance) from an outer power source to the two bus bar elements 1M and 1S in the upper side portion and the two bus bar elements 2M and 2S in the lower side portion whereby the current flows in the transparent electric conductive film 3 to heat the glass plate.

In this case, a substantial amount of current is supplied from the inner side bus bar elements 1M and 2M to the transparent electric conductive film 3, and the current from the outer side bus bar elements 1S and 2S is of only auxiliary role. If any of the bus bar elements 1M and 2M as main bus bar elements is broken at any of a upper, lower, left or right position, a substantial amount of current is instantaneously supplied to the bus bar elements 1S and 2S as auxiliary bus bar elements, and current feeding is continued to the transparent electric conductive film 3. Accordingly, there takes place no potential difference at the portion of breaking in a bus bar element, and occurrence of fire due to a spark or abnormal heating can be prevented.

In this case, a rate of increasing of current flowing in the auxiliary bus bar elements is very high. Therefore, when a change of current increase is detected, occurrence of the breakage can be detected accurately. Further, since the parallel portions of the bus bar elements are formed in the upper and lower side portions of the glass plate, accurate detection of the breakage can be obtained by detecting a change of current even when the breakage takes place at the upper side or the lower side of the glass plate.

Figure 7:
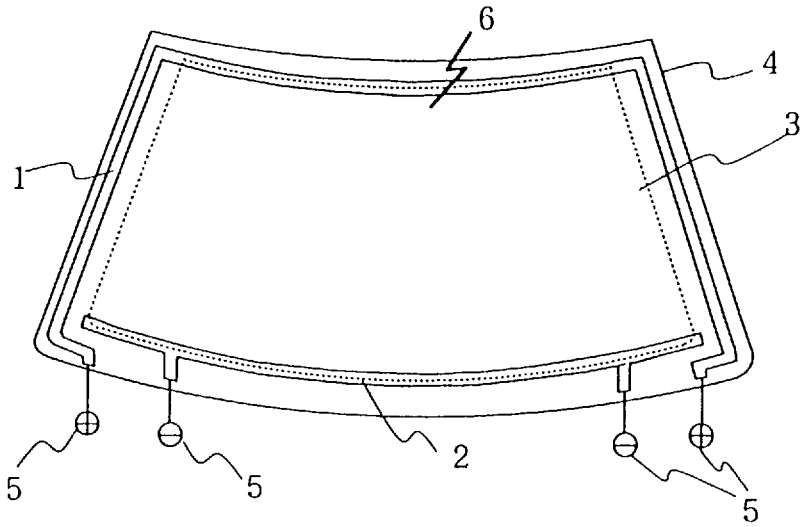
FIG. 7 PRIOR ART
FIG. 7 is a diagram showing another conventional electrically heating glass.
Figure 8:
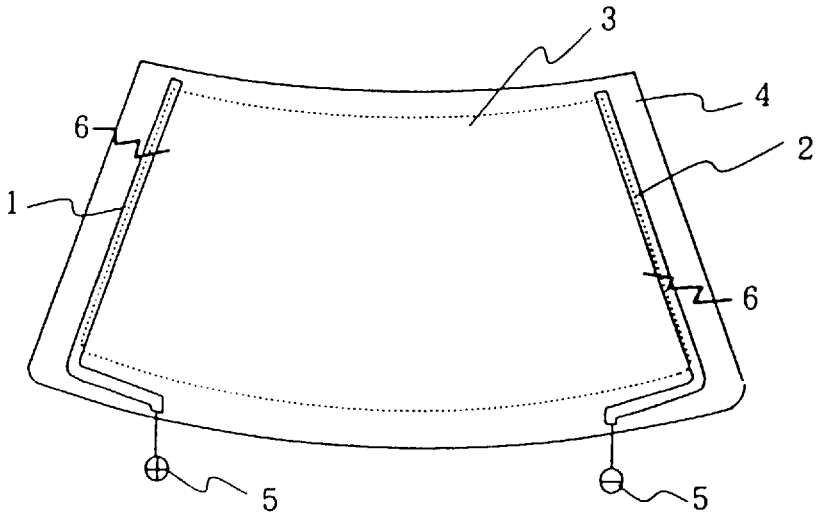
FIG. 8 PRIOR ART
FIG. 8 is a diagram showing another conventional electrically heated transparency.

On the other hand, as described with reference to FIG. 7 wherein a breakage of glass plate can be detected by detecting a value of a current flowing in the bus bar even in the conventional both side electricity feeding system. In this case, however, when the breakage occurs at a portion where the bus bar is in contact with the transparent electric conduct film at its upper or lower side, a change of current value is too small to detect the breakage of the bus bar.

EXAMPLE 2

FIG. 2 is a diagram showing in a form of model an electrically heated transparency according to the second Example. A set of bus bars respectively have two bus bar elements. As shown in FIG. 2, an upper side bus bar has bus bar elements 1S, 1M which are formed in the same manner as in Example 1. On the other hand, a lower side bus bar has bus bar elements 2S, 2M each having a parallel portion. The bus bar elements 2S, 2M are connected to a single current feeding portion to form a single bus bar which is connectable to an outer power source through a single terminal. A plurality of bus bar elements at a lower side have no connected portion other than a current feeding portion.

EXAMPLE 3

Figure 3:
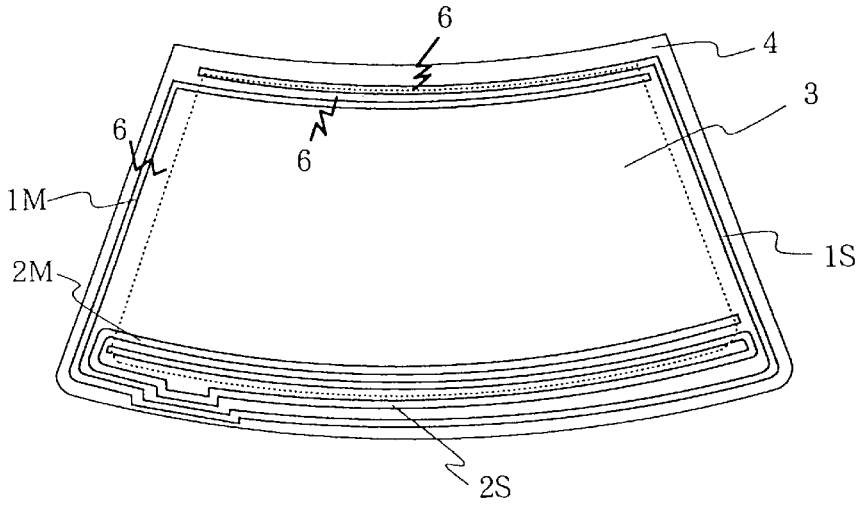
FIG. 3 is a diagram showing another embodiment of the electrically heated transparency of the present invention.

FIG. 3 is a diagram in a form of model an electrically heated transparency according to the third Example. Bus bar elements which constitute a set of bus bars are connected to a single current feeding portion to form a single bus bar as shown in FIG. 3, which is different from the case of Example 1. A plurality of bus bar elements at an upper side of the glass plate have no connected portion other than a current feeding portion. In this Example, the upper and lower bus bars are respectively connected to an outer power source through each one terminal. Accordingly, the structure can be very simple.

EXAMPLE 4

FIG. 4 is a diagram in a form of model showing an electrically heated transparency according to the fourth Example. In bus bar elements which form a set of bus bars, bus bar elements 1S, 1M as shown in FIG. 4 at an upper side of the glass plate are formed in the same manner as in Example 1.

On the other hand, bus bar elements at a lower side of the glass plate have no parallel portion different from the case of Example 1. Namely, there is a single loop-like bus bar elements wherein only a portion (which is at the side of the transparent electric conductive film) is connected to the transparent electric conductive film. By forming the lower side bus bar in such manner as described above, a surface area occupied by the lower side bus bar can be small.

EXAMPLE 5

Figure 5:
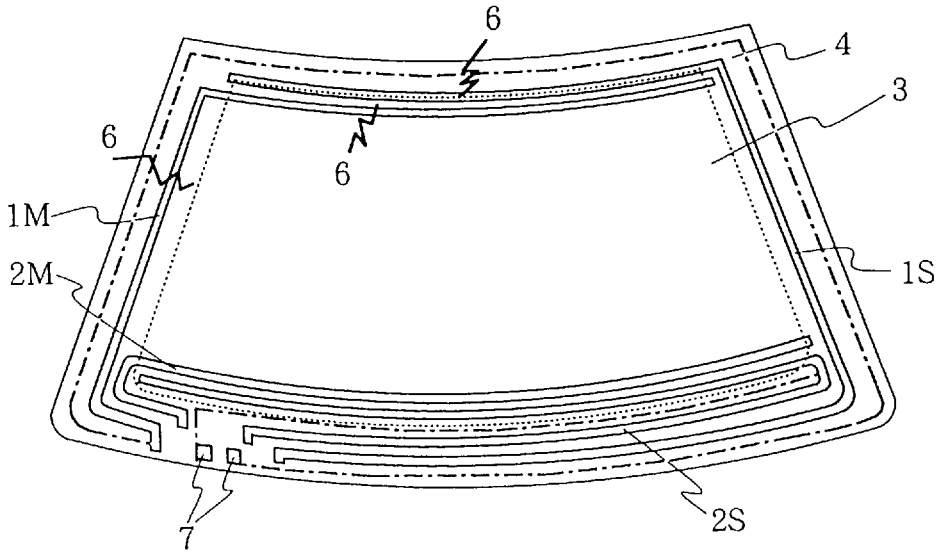
FIG. 5 is a diagram showing another embodiment of the electrically heated transparency of the present invention.
Figure 6:
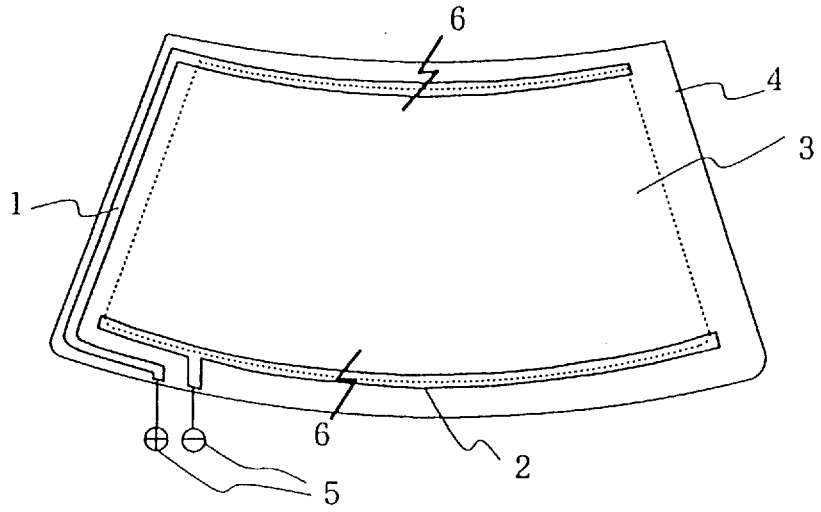
FIG. 6 PRIOR ART
FIG. 6 is a diagram showing a conventional electrically heated transparency.

FIG. 5 is a diagram showing in a form of model an electrically heated transparency according to the fifth Example. In this Example, a crack detecting means 7 is provided in the bus bars having the same structure as in Example 1. The crack detecting means 7 is connected to a detection system (not shown). With such construction, occurrence of a crack can certainly be detected to provide high reliability and safety. For instance, if any of the inner side bus bar elements 1M or 2M which contact the transparent electric conductive film 3 is broken in the case of Example 1, a current detecting means (not shown) operates to stop current feeding. However, when only the outer side bus bar element 1S or 2S is broken (there is no abnormality in the glass plate itself since the bus bar is an auxiliary bus bar), a change of current flowing in the bus bar is small, and there is a possibility that the crack detection means does not sufficiently operate.

In order to eliminate such drawback, a breakage detecting wire 7 is provided as a crack detecting means at a suitable position. Accordingly, a change of potential appearing in any bus bar or the transparent electric conductive film 3 can quickly be detected. Further, a current supplied to the transparent electric conductive film 3 can be interrupted in response to such detection.

The crack detecting means may be a breakage detecting means arranged to detect a change of voltage occurring in any bus bar or the transparent electric conductive film, or a breakage detecting means arranged to detect a change of current flowing in any bus bar or the transparent electric conductive film.

More detailed description will be made with reference to FIG. 5. In this Example, the shape of the bus bars was determined in the same manner as in FIG. 1. Further, a breakage detecting wire 7 was connected in the vicinity of the terminals 5 for the bus bars 1 and 2, and the breakage detecting wire 7 was extended along an outer side of each of the bus bars so that the breakage detecting wire 7 was extended in the vicinity of the entire peripheral portion of the glass plate. With such construction, occurrence of a crack can be instantaneously detected even when the crack takes place at any position of the four sides of the glass plate.

Namely, a voltage value and a resistance value of the detecting wire 7 in a state that a current is supplied to the transparent electric conductive film 3, are detected. Further, variations of measured values of the voltage and the resistance are detected whereby a change in the voltage or the resistance due to an abnormal state such as cutting or breakage resulted in any bus bar or the transparent electric conductive film can easily be detected.

Further, a result of measurement may be in association with control to a current to be supplied to the transparent electric conductive film 3 whereby interruption of current due to occurrence of a crack or the like can be conducted quickly. Thus, a further safe electrically heating glass can be provided. The breakage detecting means used in this case may be a breakage detecting means arranged to detect a change of voltage, or a breakage detecting means arranged to detect a change for current flowing in any bus bar or the transparent electric conductive film.

In accordance with the electrically heated transparency of the present invention, a spark or the like does not take place at a breaking portion even when a crack is resulted in any portion of the electrically heated transparency, or a breakage is resulted in any of the bus bars. Further, the sensitivity of detecting the breakage is sufficient and safety can be further improved. Therefore it is suitable for a windshield glass for vehicle.

Obviously, numerous modifications and variations of the present invention are possible in light of the above teachings. It is therefore to be understood that within the scope of the appended claims, the invention may be practiced otherwise than as specifically described herein.

What is claimed is:

1. An electrically heated transparency which comprises a glass plate, a pair of bus bars provided at upper and lower sides of the glass plate and a transparent electric conductive film disposed on a surface of the glass plate so as to connect the pair of bus bars, wherein the upper side bus bar comprises a plurality of upper bus bar elements respectively extended from current feeding portions to free ends, said free ends being located near opposite positions in an upper side portion of the glass plate; wherein said upper bus bar elements have overlapping substantially parallel connecting portions electrically connecting the upper side bus bar to the transparent electric conductive film, said parallel connecting portions opposing each other with a space therebetween.

2. The electrically heating, glass according to claim 1, wherein the plurality of upper bus bar elements of the upper side bus bar are connected to a single current feeding portion.

3. The electrically heating glass according to claim 2, wherein the lower side bus bar comprises a plurality of lower bus bar elements; wherein said lower bus bar elements are respectively extended to current feeding portions; wherein said lower bus bar elements have overlapping substantially parallel connecting portions electrically connecting the lower side bus bar to the transparent electric conductive film, said parallel connecting portions opposing each other with a space therebetween.

4. The electrically heating glass according to claim 3, wherein the plurality of lower bus bar elements of the lower side bus bar are connected to a single current feeding portion.

5. The electrically heating glass according to claim 2, wherein the lower side bus bar has a looped shape, and wherein a portion of the bus bar of looped shaped is in electrical contact with the transparent electric conductive film.

6. The electrically heating glass according to claim 1, wherein the lower side bus bar comprises a plurality of lower bus bar elements; wherein said lower bus bar elements are respectively extended from current feeding portions; wherein said lower bus bar elements have overlapping substantially parallel connecting portions electrically connecting the lower side bus bar to the transparent electric conductive film, said parallel connecting portions opposing each other with a space therebetween.

7. The electrically heating glass according to claim 6, wherein the plurality of lower bus bar elements of the lower side bus bar are connected to a single current feeding portion.

8. The electrically heating glass according to claim 1, wherein the lower side bus bar has a looped shape, and wherein a portion of the bus bar of looped shape is in electrical contact with the transparent electric conductive film.

9. The electrically heating glass according to claim 1, wherein a crack detecting wire is disposed in a peripheral portion of the glass plate.

* * * * *